US005741168A

United States Patent [19]

Chen

[11] Patent Number: 5,741,168

[45] Date of Patent: Apr. 21, 1998

[54] TOY GLIDER AS FOLDED AND ASSEMBLED FROM TWO-DIMENSIONAL ELEMENTS

[76] Inventor: Ming-Sheng Chen, c/o Hung Hsing Patent Service Center P.O. Box 55-1670, Taipei, Taiwan

[21] Appl. No.: 667,623

[22] Filed: Jun. 21, 1996

[51] Int. Cl.[6] ..... A63H 27/01

[52] U.S. Cl. ..... 446/66; 446/61; 446/67

[58] Field of Search ..... 446/61, 62, 63, 446/66, 67, 68

[56] References Cited

U.S. PATENT DOCUMENTS

| | | | |
|---|---|---|---|
| 1,818,426 | 8/1931 | Norcross | 446/61 |
| 2,168,653 | 8/1939 | Meagher, Jr. | 446/67 |
| 2,306,866 | 12/1942 | Crary | 446/62 |
| 2,351,504 | 6/1944 | Guillow | 446/68 |
| 2,505,541 | 4/1950 | Guiloow | 446/67 |
| 3,729,862 | 5/1973 | Halsey | 446/68 |
| 4,103,454 | 8/1978 | Stone | 446/67 |
| 5,007,875 | 4/1991 | Das | 446/66 |

OTHER PUBLICATIONS

Excerpts from "Spacecraft & Spaceman to Color, Cou Out and Fly!", Richard Wagner, 1977.

*Primary Examiner*—Robert A. Hafer
*Assistant Examiner*—Jeffrey D. Carlson

[57] ABSTRACT

A toy glider includes: a fuselage having a pair of bifurcated members folded from an elongated sheet to form a general triangular prism tapered forwardly, a nose member secured on a front head portion of the fuselage, a wing member cut out from a planar sheet to be a generally triangular shape and transversely inserted in a middle portion of the fuselage having a rear blade portion formed in a central rear portion of the wing member, a plurality of stabilizers each cut out from a planar sheet to be a generally semi-circular or triangular shape and horizontally inserted in a rear portion of the fuselage, and a rudder cut from a planar sheet to form a triangular shape and vertically secured on a tail portion of the fuselage, having a first stabilizer keeping a horizontal flying of the glider; a second stabilizer bending the rear blade portion of the wing member downwardly for a downward pitching for launching the glider downwardly; and a third glider upwardly bending a pair of tail flap portions of the fuselage for pitching the glider upwardly, thereby providing a glider for varying its launching orientations for player's interest.

4 Claims, 7 Drawing Sheets

FIG. 6
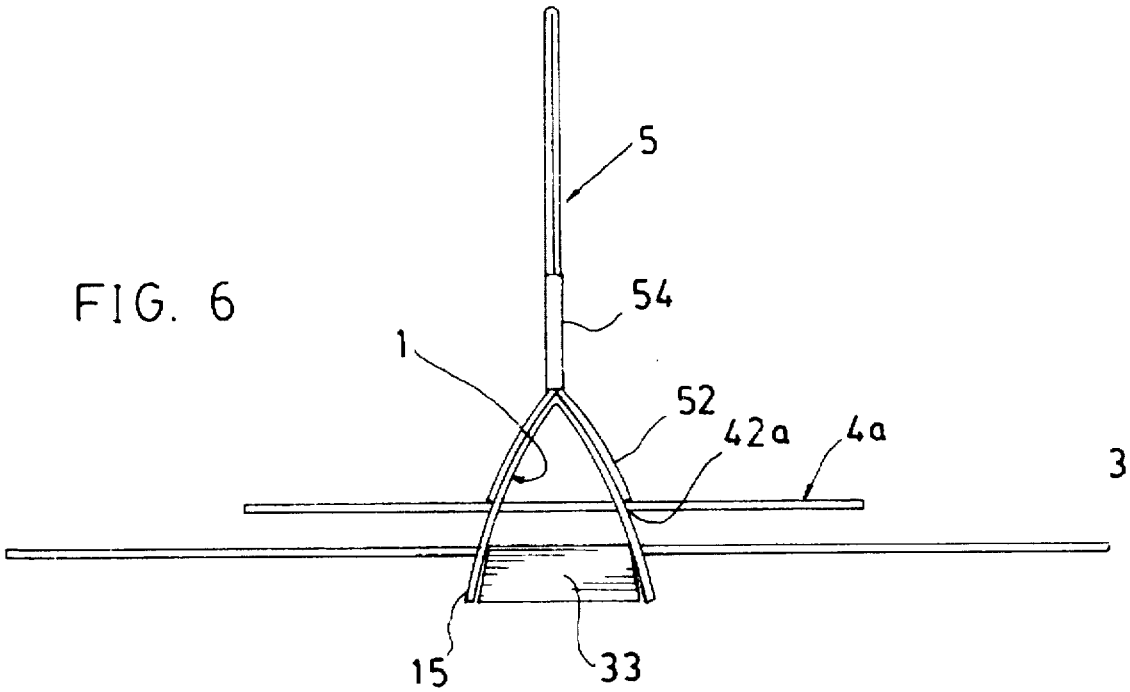
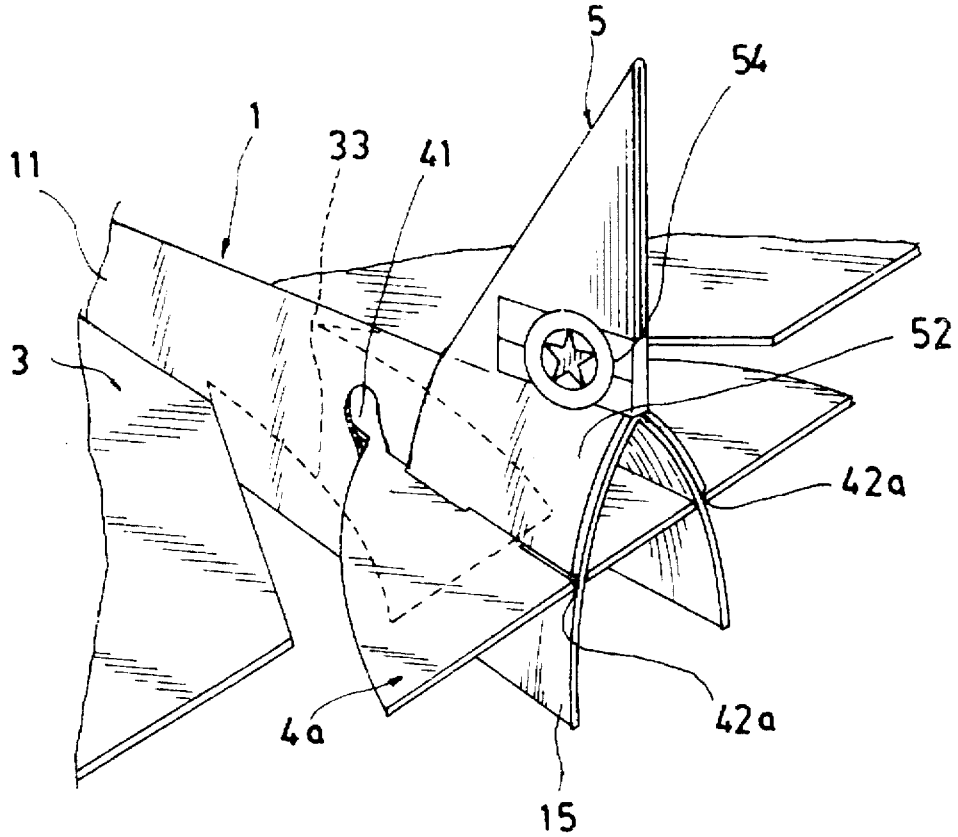
FIG. 7

TOY GLIDER AS FOLDED AND ASSEMBLED FROM TWO-DIMENSIONAL ELEMENTS

BACKGROUND OF THE INVENTION

A conventional toy glider is generally formed as fixed type, unable to be adjusted for varying the pitching angle of its elevator or wing flaps. If for adjusting the pitching angle of the elevator for changing the flying path of the glider, complex mechanism should be provided on the glider, which may not be well operated by a kid of little age. It also requires skill to assemble the glider provided with such a complex mechanism, not suitable for young kids.

The present inventor has found the drawbacks of the conventional toy glider, and invented the present toy glider which can be easily folded and assembled.

SUMMARY OF THE INVENTION

The object of the present invention is to provide a toy glider including: a fuselage having a pair of bifurcated members folded from an elongated sheet to form a general triangular prism tapered forwardly, a nose member secured on a front head portion of the fuselage, a wing member cut out from a planar sheet to be a generally triangular shape and transversely inserted in a middle portion of the fuselage having a rear blade portion formed in a central rear portion of the wing member, a plurality of stabilizers each cut out from a planar sheet to be a generally semi-circular or triangular shape and horizontally inserted in a rear portion of the fuselage, and a rudder cut from a planar sheet to form a triangular shape and vertically secured on a tail portion of the fuselage, having a first stabilizer keeping a horizontal flying of the glider; a second stabilizer bending the rear blade portion of the wing member downwardly for a downward pitching for launching the glider downwardly; and a third glider upwardly bending a pair of tail flap portions of the fuselage for pitching the glider upwardly, thereby providing a glider for varying its launching orientations for player's interest.

BRIEF DESCRIPTION OF THE DRAWINGS

FIG. 6 is a rear view of the present invention showing a second stabilizer for downward pitching.

FIG. 7 is a perspective view of the present invention as shown in FIG. 6.

DETAILED DESCRIPTION

Figure 1:
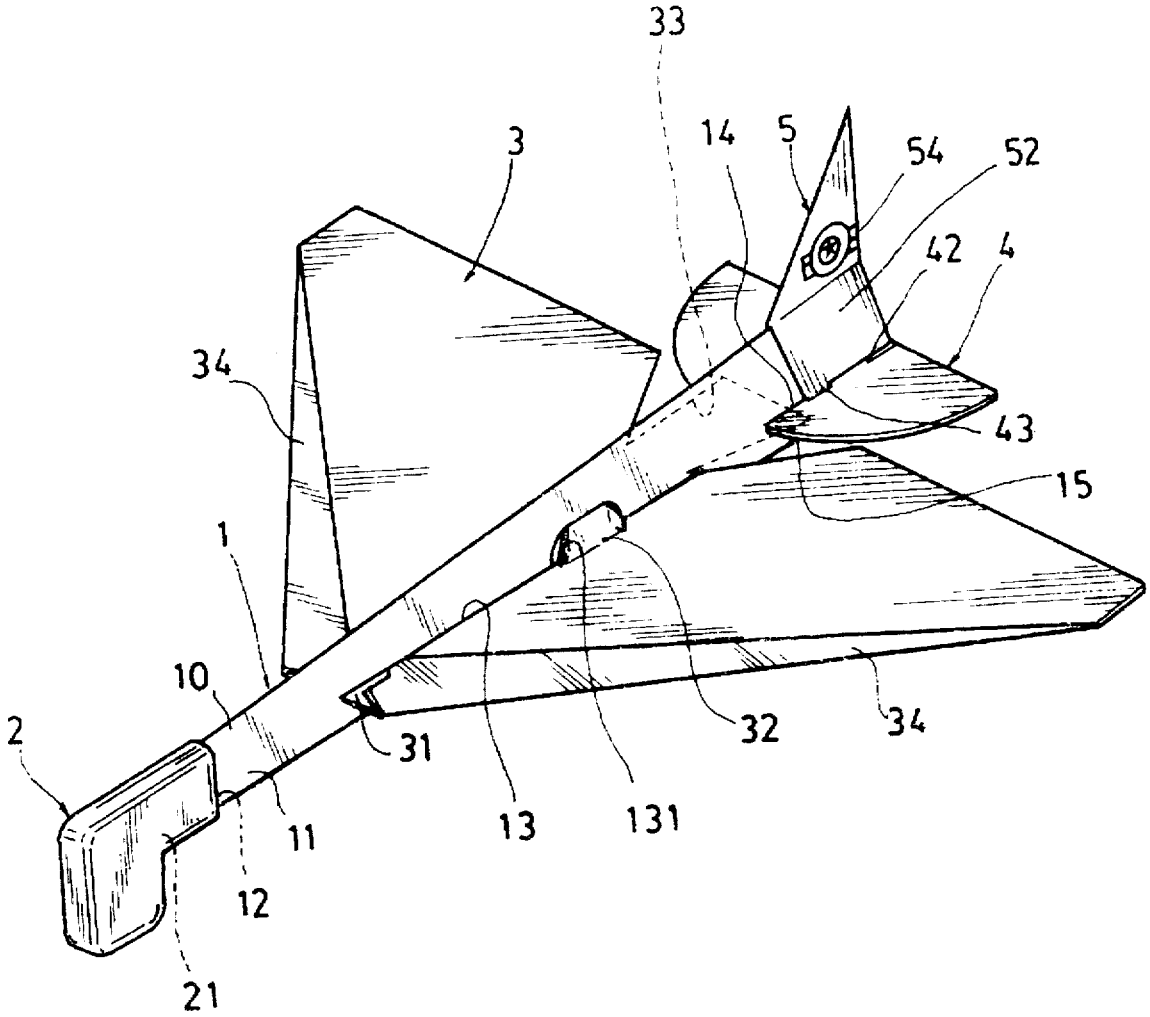
FIG. 1 is a perspective view of the present invention when assembled.
Figure 2:
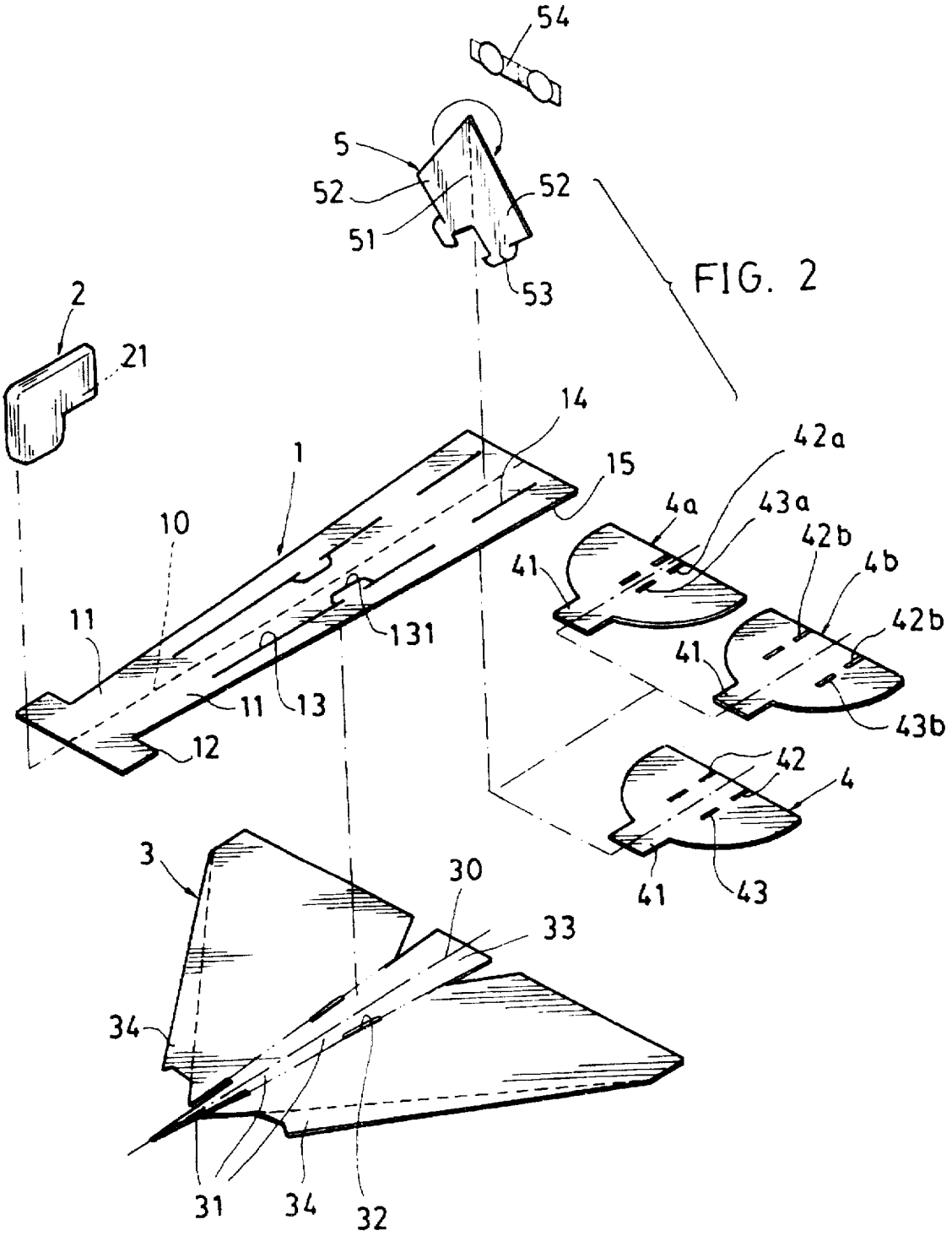
FIG. 2 is an exploded view of all two-dimensional elements in construction of the present invention.
Figure 3:
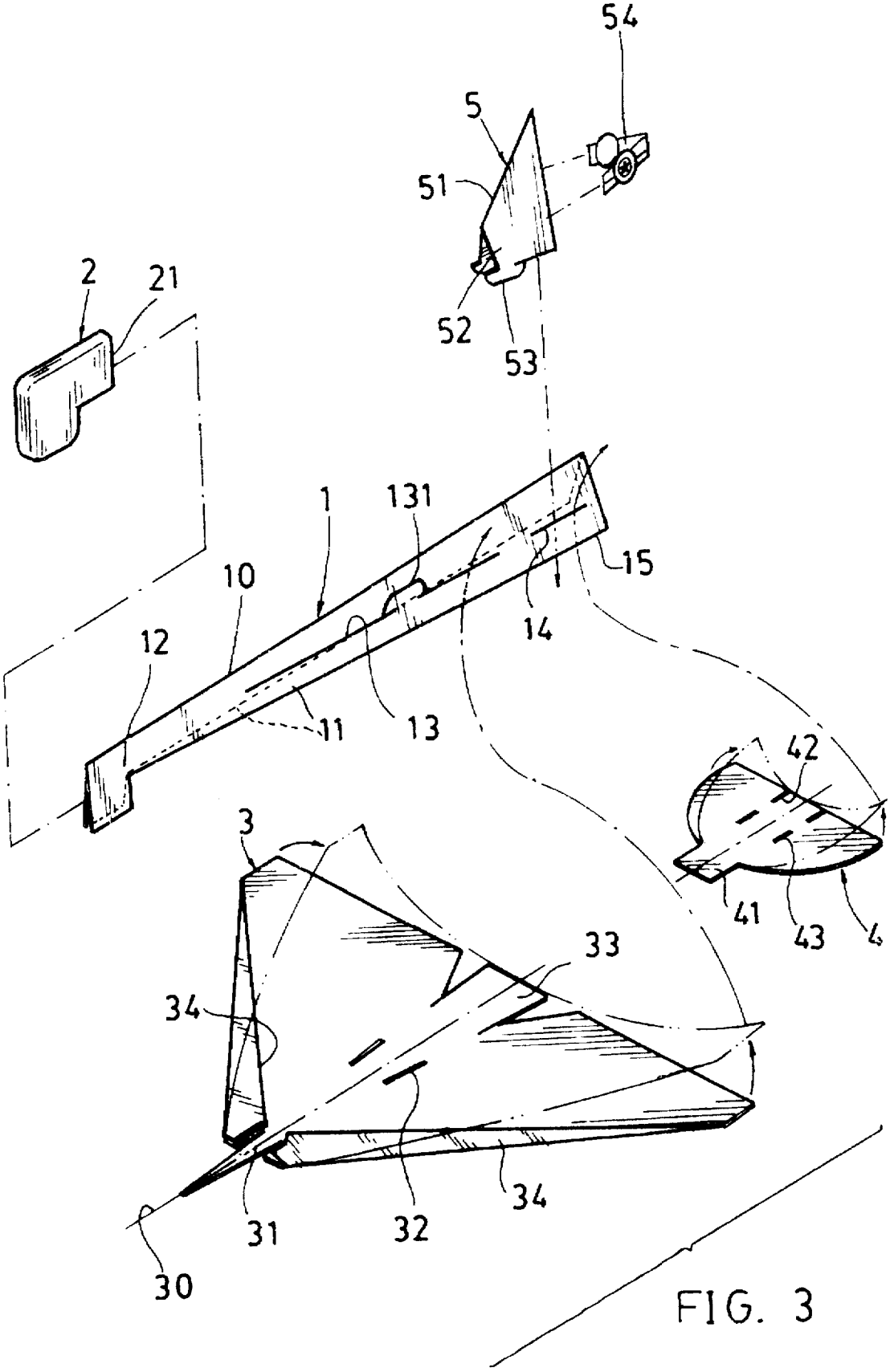
FIG. 3 shows all folded elements before being assembled for forming a toy glider in accordance with the present invention.

As shown in FIGS. 1–3, a preferred embodiment of the toy glider of the present invention comprises: a fuselage 1, a nose member 2, a wing member 3, a stabilizer 4 and a rudder 5. All elements except the nose member 2 may be directly cut out from a planar plastic or paper sheet for the purpose of do-it-yourself (D-I-Y).

The fuselage 1 includes: a pair of bifurcated members 11 folded along a central folding line 10 defined at a longitudinal center of the fuselage 1 to form a generally triangular prism tapered forwardly, a front head portion 12 formed on a front portion of the fuselage 1 and engageable with a socket 21 recessed in the nose member 2 for securing the nose member 2 on the front head portion 12 of the fuselage 1, a pair of wing slits 13 juxtapositionally slotted in a central portion of the fuselage 1 for transversely inserting the wing member 3 in the wing slits 13 and a pair of rear slits 14 juxtapositionally slotted rear portion of the fuselage adjacent to a pair of tail flap portions 15 of the fuselage 1 for transversely inserting the stabilizer 4 in the rear slits 14, with each wing slit 13 and rear slit 14 being horizontally parallel to each other.

The wing member 3 includes: a central spacing portion 31 disposed at a longitudinal center 30 of the wing member 3 and generally triangular shaped and tapered forwardly to be spaced in between the pair of bifurcated members 11 of the fuselage 1, a pair of fixing slots 32 longitudinally slotted in a central portion of the wing member 3 for respectively engaging a pair of central lugs 131 formed on the fuselage 1 for horizontally securing the wing member 3 on the central portion of the fuselage 1, a rear blade portion 33 protruding rearwardly from the wing member 3 to be spaced between the pair of tail flap portions 15 of the fuselage 1 and a pair of reinforced rib portions 34 respectively rearwardly bent from a front right and left portion of the wing member 3 for preventing deformation of the wing member 3 during flying.

Figure 5:
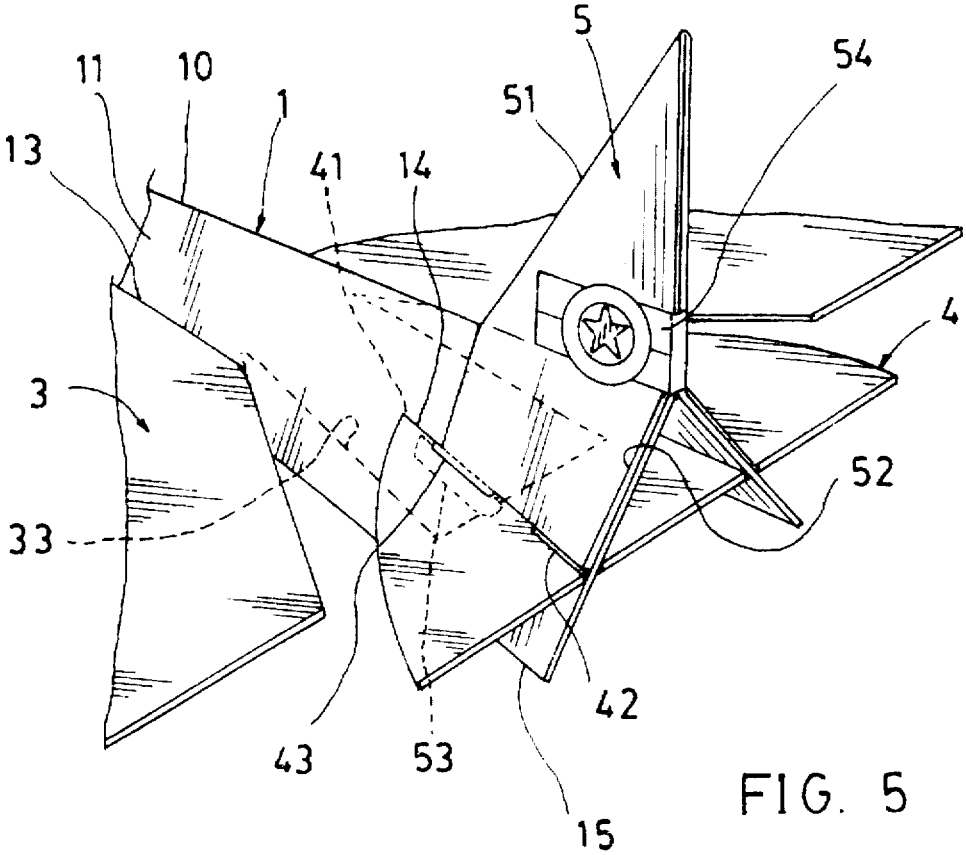
FIG. 5 is a perspective view of the present invention as shown in FIG. 4.
Figure 9:
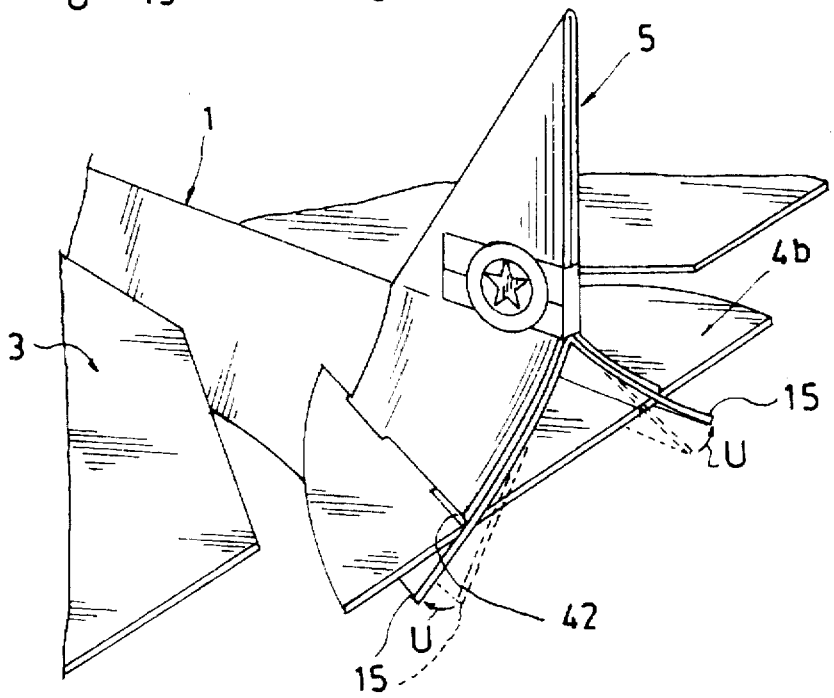
FIG. 9 is a perspective view of the present invention as shown in FIG. 8.

The stabilizers include a first, second and third stabilizer 4, **4*a*, 4*b* each including: a central stem 41 spaced between the two bifurcated members 11 of the fuselage 1, a pair of control slits 42, 42*a*, 42*b* juxtapositionally slotted in a rear portion of the stabilizer 4, 4*a*, 4*b* to be engaged with the pair of tail flap portions 15 of the fuselage 1 especially as shown in FIGS. 5, 7 and 9, and a pair of retaining slits 43, 43*a*, 43*b* juxtapositionally slotted in a middle portion of the stabilizer 4 each retaining slit 43, 43*a*, 43*b* for engaging a rudder lug 53 of the rudder 5**.

The rudder 5 includes: a pair of fork portions 52 folded from a rudder folding line 51 to be disposed on two tail flap portions 15 of the fuselage 1, each fork portion 52 having a rudder lug 53 formed on a lower end portion of the fork portion 52 to be engaged with each retaining slit 43, **43*a*, 43*b* slotted in the stabilizer 4, 4*a*, 4*b* for firmly securing the rudder 5 and the stabilizer 4 on a tail portion of the fuselage 1 and a sticker 54 for binding the pair of fork portions 52 of the rudder 5**.

Figure 4:
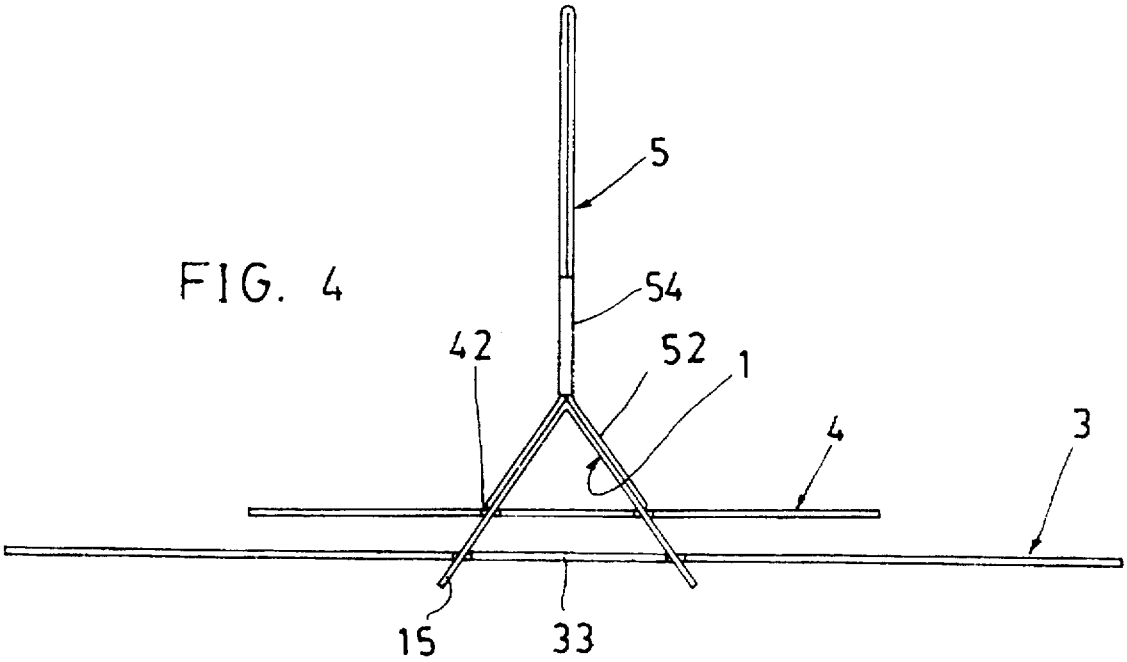
FIG. 4 is a rear view of the glider of a first stabilizer for horizontal flying in accordance with the present invention.
Figures 11, 12, 13:
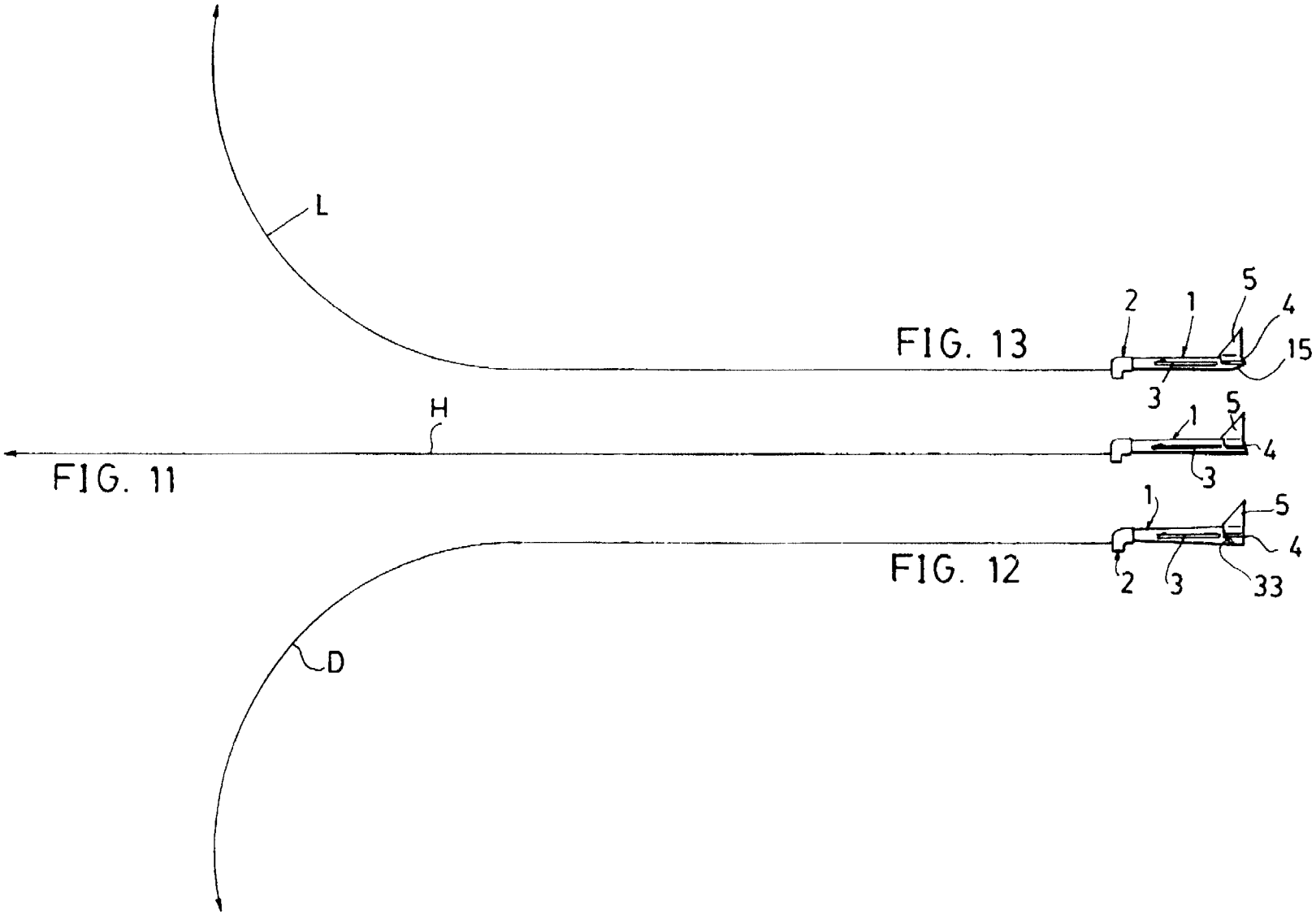
FIG. 11 shows the present invention for horizontal flying.
FIG. 12 shows the present invention for downward pitching.
FIG. 13 shows the present invention for upward pitching.

The first stabilizer 4 of the present invention as shown in FIGS. 4, 5 includes a pair of first control slits 42 juxtapositionally slotted in a rear portion of the stabilizer 4 to be engaged with the pair of rear slits 14 of the fuselage 1 to horizontally keep the rear blade portion 33 of the fuselage 1 for a horizontal launching (H) as shown in FIG. 11.

The second stabilizer **4*a* as shown in FIGS. 6, 7 includes a pair of second control slits 42*a* having a distance between the two second control slits 42***a* smaller than the distance between the pair of first control slits 42 for narrowing the pair of tail flap portions 15 for downwardly bending the rear blade portion 33 of the fuselage 1 for downwardly pitching (D) the glider as shown in FIG. 12 due to a larger wind resistance as sustained by the glider below the second stabilizer 4*a* than that of the first stabilizer 4.

Figure 8:
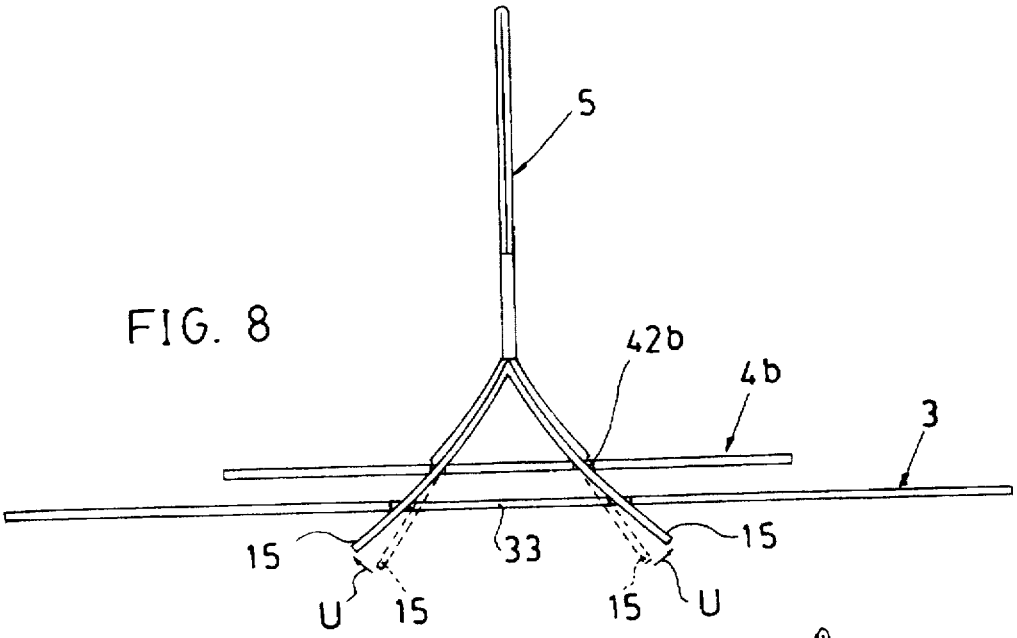
FIG. 8 is a rear view of the present invention showing a third stabilizer for upward pitching.
Figure 10:
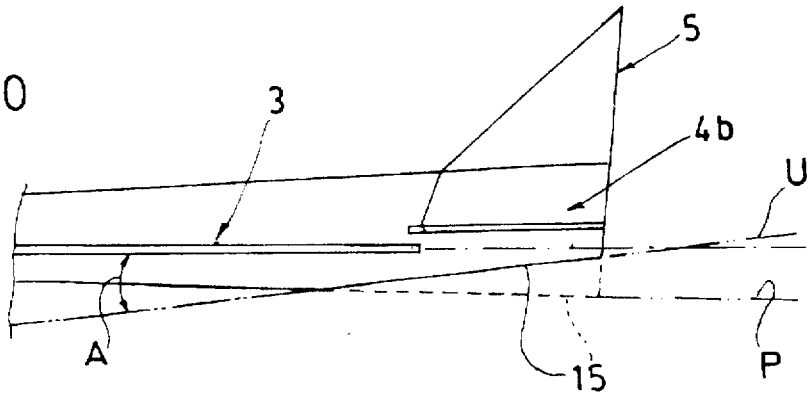
FIG. 10 is a partial front view of the present invention as shown in FIGS. 8, 9.

The third stabilizer 4*b* as shown in FIGS. 8–10 includes a pair of third control slits 42*b* having a distance between the two third control slits 42*b* larger than the distance between the pair of first control slits 42 for widening the pair of tail flap portions 15 for upwardly bending (U) the pair of tail flap portions 15 from a horizontal bottom P for raising a lifting angle A defined between the wing member 3 and the tilted bottom of the tail flap portion 15, thereby upwardly pitching (L) the glider as shown in FIG. 13.

The present invention is superior to the conventional toy glider for a convenient self manipulation, assembly operation, which may be catapulted such as by an elastic ring at the nose member 2 generally L shaped. Also, three launching orientations, namely: horizontal flying (H), upward lifting (L), and downward pitching (D) as shown in FIGS. 11–13, can be selectively obtained for enhancing the interest of the players.

The present invention may be modified without departing from the spirit and scope of the present invention.

I claim:

1. A toy glider comprising:

a fuselage (1) cut out from a planar sheet and including: a pair of bifurcated members (11) folded along a central folding line (10) defined at a longitudinal center of the fuselage (1) to form a generally triangular prism tapered forwardly, a front head portion (12) formed on a front portion of the fuselage (1) and engaged in a nose member (2), securing said nose member (2) on the front head portion (12) of the fuselage (1), a pair of wing slits (13) juxtapositionally slotted in a central portion of the fuselage (1) for transversely inserting the wing member (3) in the wing slits (13), a pair of rear slits (14) juxtapositionally slotted in a rear portion of the fuselage for transversely inserting the stabilizer (4) in the rear slits (14), and a pair of tail flap portions (15) disposed on a rear portion of the fuselage adjacent to the pair of the rear slits (14), with each wing slit (13) and rear slit (14) being horizontally parallel to each other;

a wing member (3) cut out from the planar sheet and horizontally transversely fixed in a middle portion of the fuselage (1), said wing member (3) having a rear blade portion (33) protruding rearwardly to be spaced between the pair of tail flap portions (15) of the fuselage (1);

a stabilizer (4, 4*a*, 4*b*) cut out from the planar sheet and selectively horizontally secured on a rear portion of said fuselage;

a rudder (5) cut out from the planar sheet and vertically secured on the rear portion of the fuselage (1) and having a pair of rudder lugs (53) formed on a lower end portion of the rudder; said stabilizer (4, 4*a*, 4*b*) operatively adjusting a pitching angle of the fuselage as subjected to different wind resistance on said stabilizer and said fuselage; and said stabilizer including a central stem (41) spaced between the two bifurcated members (11) of the fuselage (1), a pair of control slits (42, 42*a*, 42*b*) juxtapositionally slotted in a rear portion of the stabilizer to be engaged with the pair of tail flap portions (15) of the fuselage (1), and a pair of retaining slits (43, 43*a*, 43*b*) juxtapositionally slotted in a middle portion of the stabilizer each retaining slit engaging each said rudder lug (53) of the rudder (5).

2. A toy glider according to claim 1, wherein said stabilizer (4) includes a pair of first control slits (42) juxtapositionally slotted in a rear portion of the stabilizer (4) to be engaged with the pair of rear slits (14) of the fuselage (1) adjacent to the pair of tail flap portions (15) of the fuselage (1) to horizontally keep the rear blade portion (33) of the fuselage (1) for a horizontal launching (H) of the fuselage.

3. A toy glider according to claim 2, wherein said stabilizer comprises a second stabilizer (4*a*) that includes: a pair of second control slits (42*a*) having a distance between the two second control slits (42*a*) smaller than the distance between the pair of first control slits (42) for narrowing the pair of tail flap portions (15) for downwardly bending the rear blade portion (33) of the fuselage (1) for downwardly pitching (D) the fuselage due to a larger wind resistance as sustained by the glider below the second stabilizer (4*a*) than that of the first stabilizer (4).

4. A toy glider according to claim 2, wherein said stabilizer comprises a third stabilizer (4*b*) that includes a pair of third control slits (42*b*) having a distance between the two third control slits (42*b*) larger than the distance between the pair of first control slits (42) for widening the pair of tail flap portions (15) for upwardly bending (U) the pair of tail flap portions (15) from a horizontal bottom plane (P) for raising a lifting angle (A) defined between the wing member (3) and a bottom of the tail flap portion (15) for upwardly pitching (L) the fuselage.

* * * * *